US005857720A

United States Patent [19]

Kim

[11] Patent Number: 5,857,720

[45] Date of Patent: Jan. 12, 1999

[54] OPENING DEVICE FOR A MICROWAVE OVEN DOOR

[75] Inventor: Sang-Jin Kim, Incheon, Rep. of Korea

[73] Assignee: Daewoo Electronics, Co. Ltd., Seoul, Rep. of Korea

[21] Appl. No.: 766,261

[22] Filed: Dec. 13, 1996

[30] Foreign Application Priority Data

| | | | |
|---|---|---|---|
| Dec. 13, 1995 | [KR] | Rep. of Korea | 1995-40758 |
| Dec. 28, 1995 | [KR] | Rep. of Korea | 1995/50036 |
| Dec. 28, 1995 | [KR] | Rep. of Korea | 1995-50037 |

[51] Int. Cl.[6] ..... E05C 19/10

[52] U.S. Cl. ..... 292/98; 292/DIG. 37; 292/DIG. 61

[58] Field of Search ..... 292/98, 140, 147, 292/DIG. 37, DIG. 38, DIG. 54, DIG. 61, DIG. 69

[56] References Cited

U.S. PATENT DOCUMENTS

| | | | |
|---|---|---|---|
| 1,152,728 | 9/1915 | Hathaway | 292/DIG. 37 |
| 2,047,401 | 7/1936 | Whitted | 292/DIG. 37 |
| 4,842,312 | 6/1989 | Iwasaki | 292/DIG. 37 |
| 4,864,835 | 9/1989 | Wartian | 292/DIG. 37 |
| 4,895,401 | 1/1990 | Thornton | 292/DIG. 37 |
| 5,062,671 | 11/1991 | Goetz | 292/DIG. 61 |

*Primary Examiner*—Flemming Saether
*Attorney, Agent, or Firm*—Sixbey, Friedman Leedom & Ferguson; Frank P. Presta; Joseph S. Presta

[57] ABSTRACT

The present invention is related to an opening device for a microwave oven door. A hook is moved up and down to open/close the door. A swing lever moves the hook upwardly when swinging around a swing shaft at a predetermined angle. An elastic piece is protrudingly formed from an inside of the microwave oven to the swing lever for supporting the swing lever through one direction. By this construction, the elastic piece is deformed because the swing lever is swung. This bending restoring force restores the push button and swing lever to their initial positions, when the push button is released. As a result, the push button is restored without special spring part. Therefore, the number of parts is decrease, and the production cost is lowered. Also, the assembling work is improved, since the elastic piece is produced with swing lever integrally.

6 Claims, 8 Drawing Sheets

OPENING DEVICE FOR A MICROWAVE OVEN DOOR

BACKGROUND OF THE INVENTION

1. Field of the Invention

The present invention relates to a microwave oven, and more particularly to an opening device for a microwave oven door.

2. Description of the Prior Art

Generally, for opening a conventional microwave oven, a push button installed in the front surface of the microwave oven is used. FIG. 1 is a side sectional view of the conventional opening device for a microwave oven door. As shown in FIG. 1, the opening device mainly consists of a push button 3, swing lever 9, hook lever 11, and hook 15.

The push button 3 is located under a control panel 1 and is capable of being pushed inside the microwave oven to a predetermined distance. Button shaft 5 is installed in push button 3, and a spring 7 is assembled around the button shaft 5.

The swing lever 9 is installed in the rear surface of control panel 1. A swing shaft 15 is installed to be swung on the rear surface of the control panel 1. A protrusion 17 is formed where the button shaft 5 contacts the swing lever 9.

The hook lever 11 is installed to be swung in the upper portion of the swing lever 9. One end of hook lever 11 is contacted to hook 15. A lock panel 13 in which the hook lever 11 is assembled limits the swing angle of the hook lever 11. The hook 15 can be moved up and down by hook lever 11. The hook 15 opens the door(not shown) by being moved upwardly, and closes the door(not shown) by being moved downwardly.

The conventional opening device for a microwave oven door is operated as below.

When the user pushes the push button 3 with hand, the push button 3 is pushed inside the microwave oven against the elastic force of the spring 7. Button shaft 5 swings the swing lever 9, thereby contacting the protrusion 17. Then the swing lever 9 swings around the swing shaft 15. The upper surface of the swing lever 9 touchs one end of hook lever 11. The hook lever 11 moves the hook 15 upwardly when swinging. Therefore, the microwave oven door(not shown) is opened. After that, push button 3 is returned to its initial position by the elastic force of the spring 7. The swing lever 9, hook lever 11, and hook 15 are also returned to their initial positions, when the push button 3 is returned.

In order to close the door, the user swings the door shut directly without any button operation.

The conventional opening device for a microwave oven door operated as above has problems because the manufacturing cost is high and the assembling work is difficulty since the spring has to be assembled.

SUMMARY OF THE INVENTION

Therefore, the present invention is devised to solve the foregoing problems. It is an object of the present invention to provide a opening device for a microwave oven door, wherein the number of parts is reduced and the assembling property is improved.

To achieve the above object of the present invention, an opening device for a microwave oven door including a hook is moved up and down to open/close the door. A swing lever is able to move the hook upwardly when swinging around a swing shaft at a predetermined angle. Also an elastic piece is protrudingly formed from the inside of the microwave oven to the swing lever for supporting the swing lever through one direction.

Preferably, the swing lever is swung by a push button installed beside the door, and formed with a protrusion in a region that the swing lever is in contact with the push button.

More preferably, the swing shaft is fixed to be swingable on a rear surface of a control panel in which installed in a front surface of the microwave oven.

Here, the elastic piece is protrudingly formed from a rear surface of a control panel which is installed in a front of the microwave oven, and attached to an upper surface of the swing lever elastically.

As an alternative aspect of the present invention, an opening device for a microwave oven door including a hook is moved up and down to open/close the door. Also, a swing lever including a protrusion formed in a region where a push button installed beside the door is contacted and a swing shaft fixed to be swingable on a rear surface of a control panel installed in a front of the microwave oven, moves the hook upwardly when swinging around a swing shaft at a predetermined angle by the push button. Also an elastic piece is protrudingly formed from the rear surface of the control panel to an upper surface of the swing lever for supporting the swing lever through one direction, as attached to the upper surface of the swing lever elastically.

The opening device for a microwave oven door constructed as above is operated as below.

When the user pushes the push button with hand, the push button is pushed inside the microwave oven. Accordingly button shaft swings the swing lever, contacting the protrusion. Then the swing lever swings around the swing shaft. The upper surface of the swing lever touchs one end of hook lever. The hook lever moves the hook upwardly when swinging. Therefore, the microwave oven door(not shown) is opened. The free end of elastic piece is bent by the swing lever. After that, push button is returned to its initial position by the restoring force of the elastic piece. The swing lever, hook lever, and hook are also returned to their initial positions, when the push button is returned.

When the user closes the door, the user swings the door shut directly without any button operation.

Therefore, according to the opening device for a microwave oven operated as above, it is possible to restore the swing lever and push button to their respective initial position without a special spring part. These features cause the effect in which the number of parts is reduced, the production cost is lowered and the assembling work is improved.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Hereinafter, an opening device for a microwave oven door according to the present invention will be described in detail with reference to each embodiment illustrated in the accompanying drawings.

Figure 1:
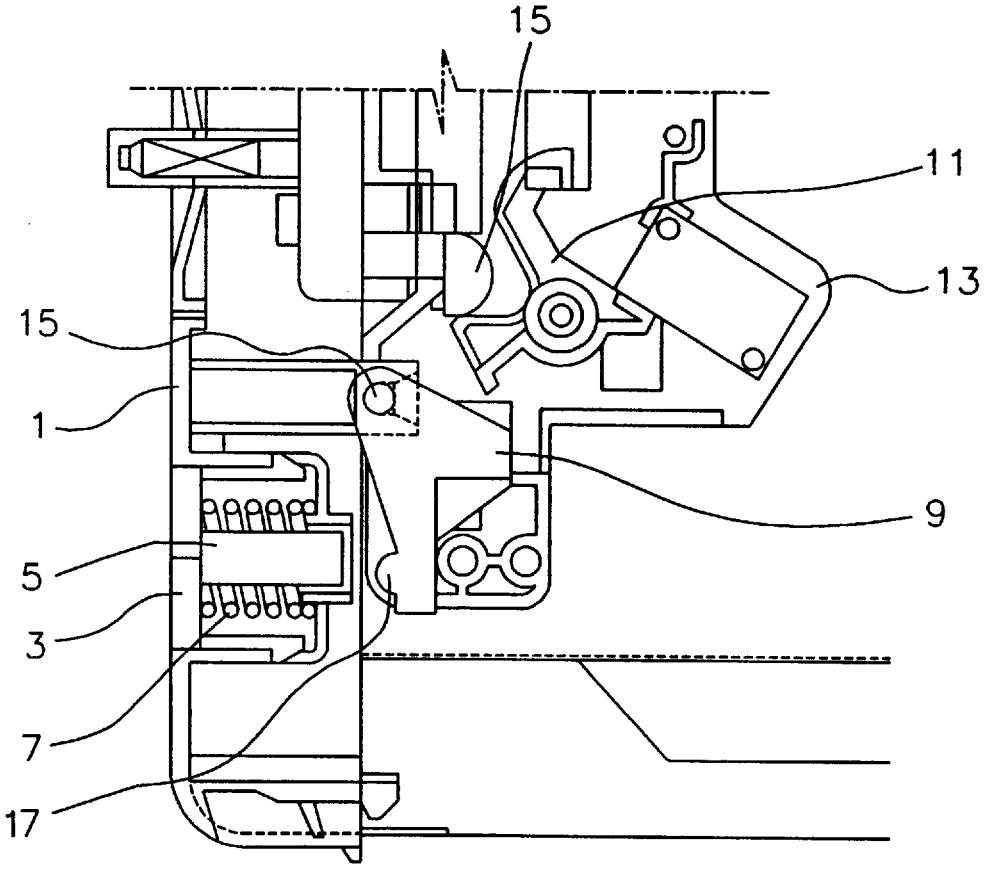
FIG. 1 PRIOR ART
FIG. 1 is a side sectional view of the conventional opening device,for a microwave oven door.
Figure 2:
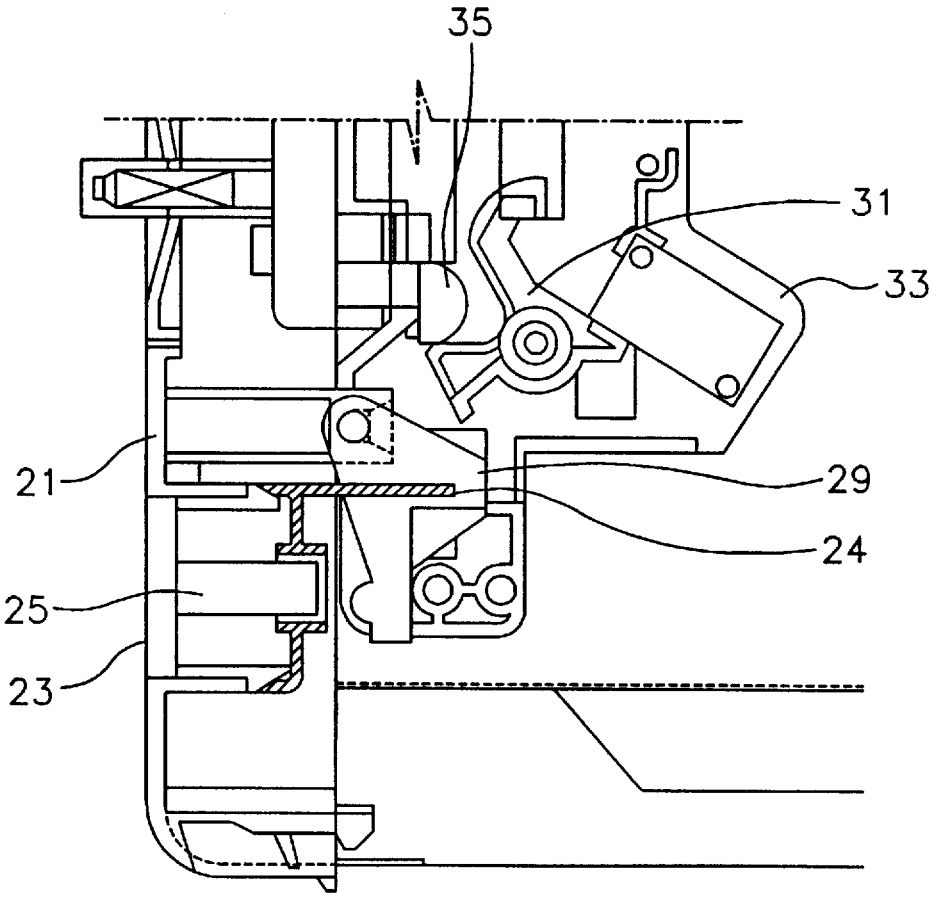
FIG. 2 is a side sectional view of the opening device for a microwave oven door according to the first embodiment of the present invention.
Figure 3:
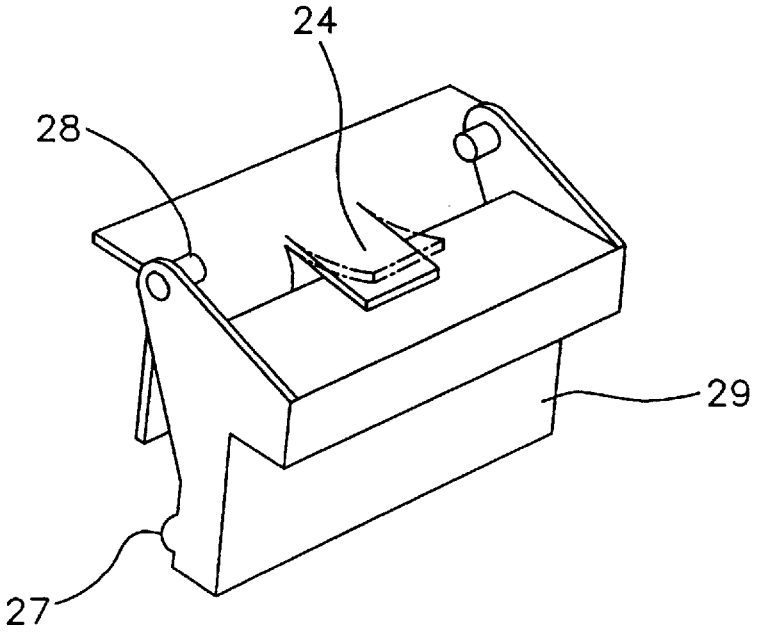
FIG. 3 is a perspective view of the swing lever of the opening device shown in FIG. 2.
Figure 4:
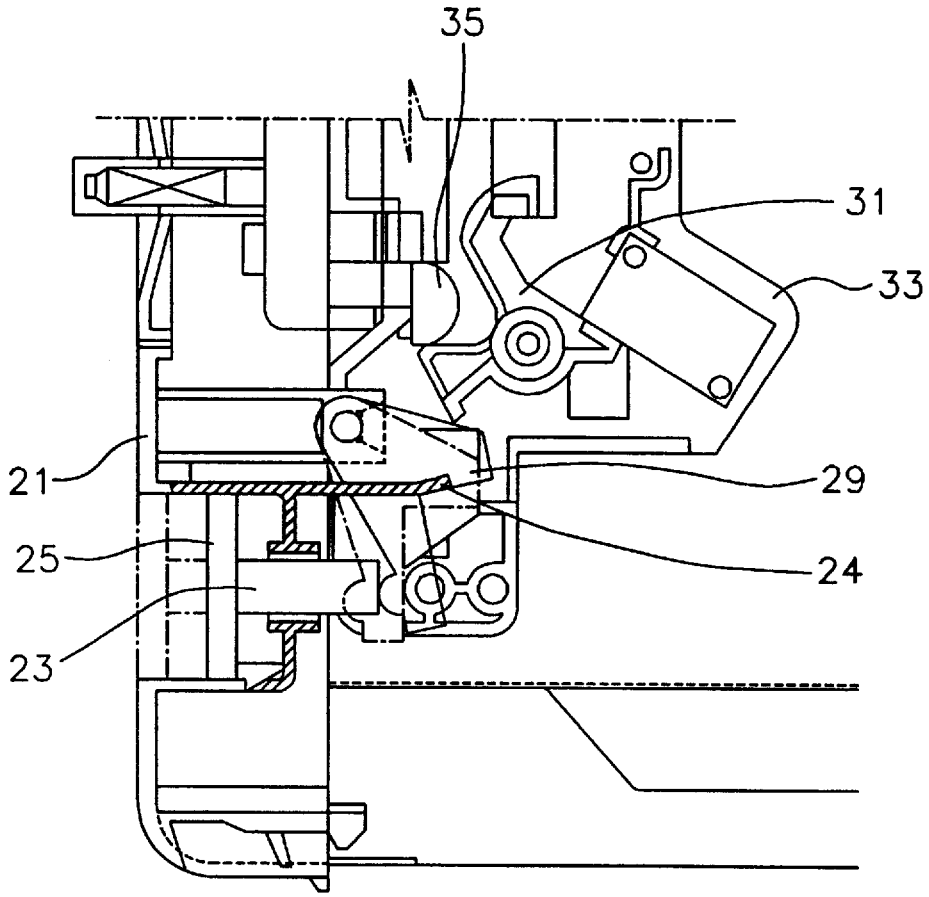
FIG. 4 is an operational view of the opening device shown in FIG. 2

FIG. 2 is a side sectional view of the opening device for a microwave oven door according to the first embodiment of the present invention, FIG. 3 is a perspective view of the swing lever of the opening device shown in FIG. 2, and FIG. 4 is an operational view of the opening device shown in FIG. 2. As shown in FIGS. 2, 3 and 4, the opening device mainly consists of a push button 23, swing lever 29, hook lever 31, and hook 35.

The push button 23 is located under a control panel 21, and capable of being pushed inside the microwave oven at a predetermined distance. Button shaft 25 is installed in push button 23.

The swing lever 29 is installed in the rear surface of control panel 21. A swing shaft 28 is installed to be swung on the rear surface of the control panel 21. A protrusion 27 is formed where the button shaft 25 contacts the swing lever 29.

The one end of the first elastic piece 24 is fixed on the rear surface of the control panel 21, and the other end elastically presses the upper surface of the swing lever 29 as a free end. The first elastic piece 24 acts like a leaf spring, which forces the bending restoring force to the swing lever 29 in a clockwise direction. This first elastic piece 24 is made by bending the rear housing of the control panel 21 and incising some portion.

The hook lever 31 is installed to be swung in the upper portion of the swing lever 29. One end of hook lever 31 is contacted to hook 35. A lock panel 33 in which the hook lever 31 is assembled limits the swing angle of the hook lever 31. The hook 35 can be moved up and down by hook lever 31. The hook 35 opens the door(not shown) by being moved upwardly, and closes the door(not shown) by being moved downwardly.

Figure 5:
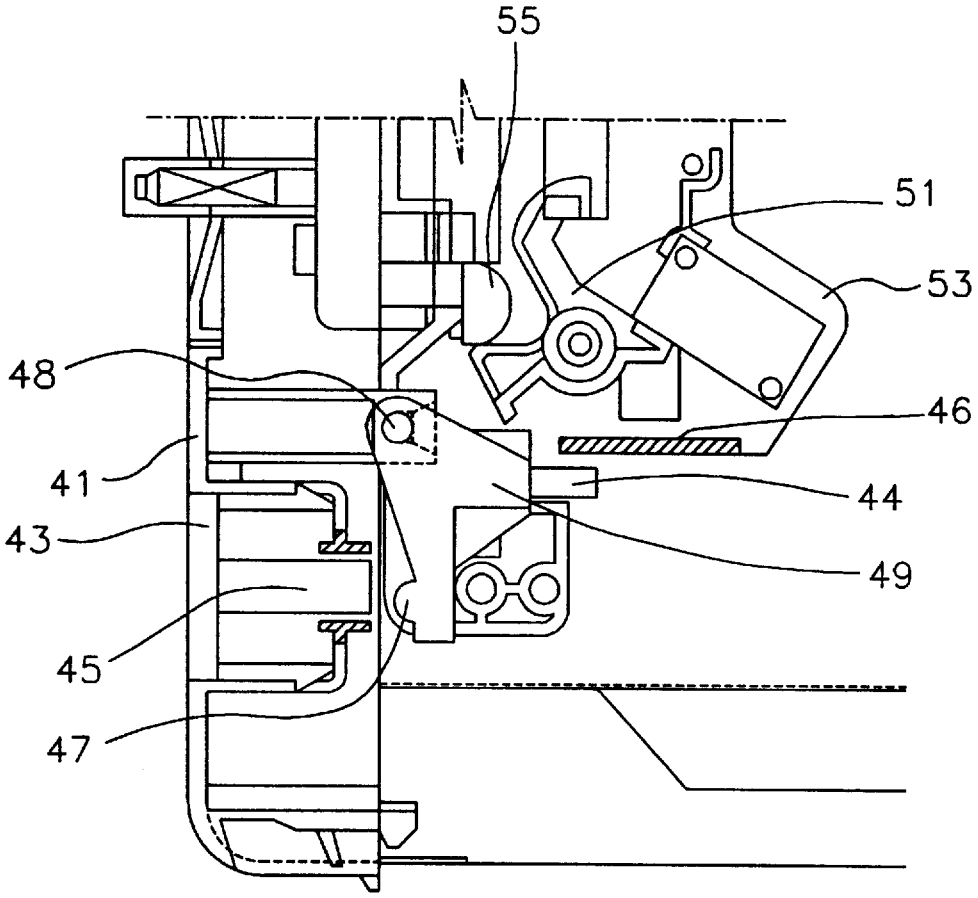
FIG. 5 is a side sectional view of the opening device for a microwave oven door according to the second embodiment of the present invention.
Figure 6:
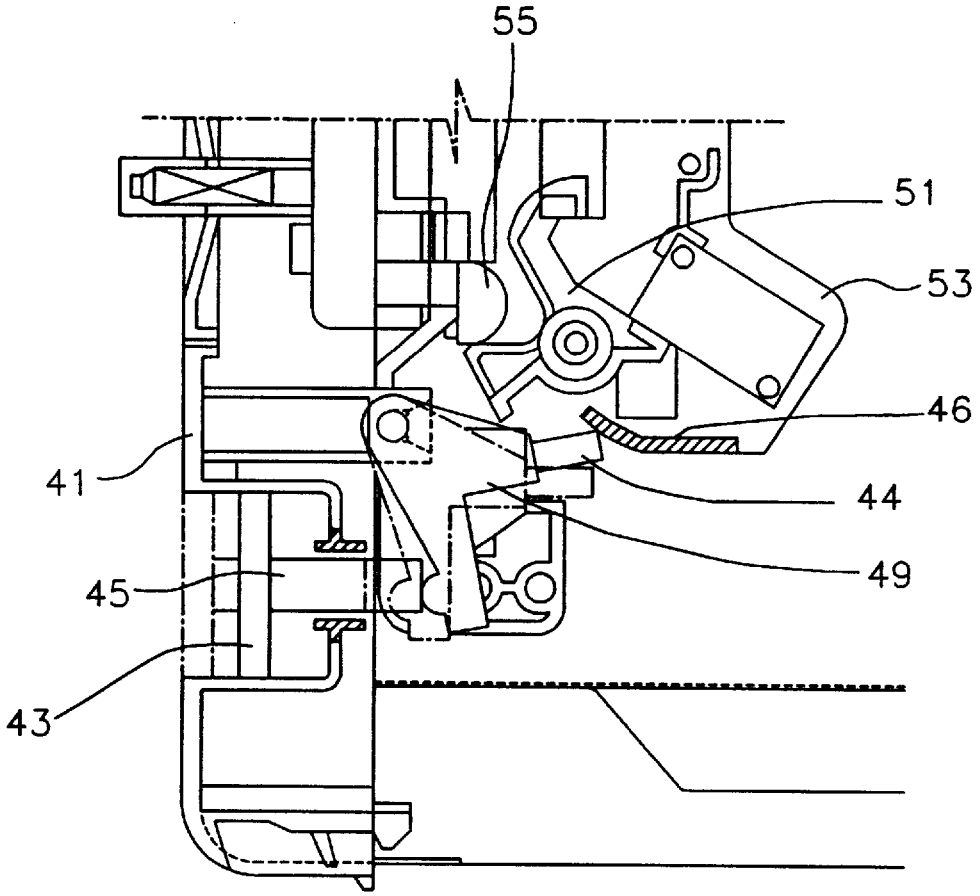
FIG. 6 is an operational view of the opening device shown in FIG. 5

FIG. 5 is a side sectional view of the opening device for a microwave oven door according to the second embodiment of the present invention, and FIG. 6 is an operational view of the opening device shown in FIG. 5. As shown in FIGS. 5 and 6, the opening device mainly consists of push button 43, swing lever 49, hook lever 51, and hook 55.

The push button 43 is located under a control panel 41, and capable of being pushed inside the microwave oven at a predetermined distance. Button shaft 45 is installed in push button 43.

The swing lever 49 is installed in the rear surface of control panel 41. A swing shaft 48 is installed to be swung on the rear surface of the control panel 41. A protrusion 47 is formed where the button shaft 45 contacts the swing lever 49.

The one end of the second elastic piece 46 is fixed on the lock panel 53, and the other end is extended into the swing piece 44 swing range as a free end. The second elastic piece 46 acts like a leaf spring, which forces the bending restoring force to the swing lever 49.

The hook lever 51 is installed to be swung in the upper portion of the swing lever 49. One end of hook lever 51 is contacted to hook 55. A lock panel 53 in which the hook lever 51 is assembled limits the swing angle of the hook lever 51. The hook 55 can be moved up and down by hook lever 51. The hook 55 opens the door(not shown) by being moved upwardly, and closes the door(not shown) by being moved downwardly.

Figure 7:
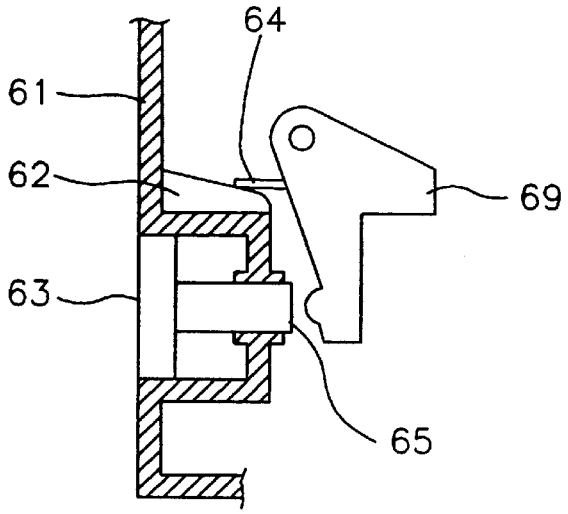
FIG. 7 is a side sectional view of the opening device for a microwave oven door according to the third embodiment of the present invention.
Figure 8:
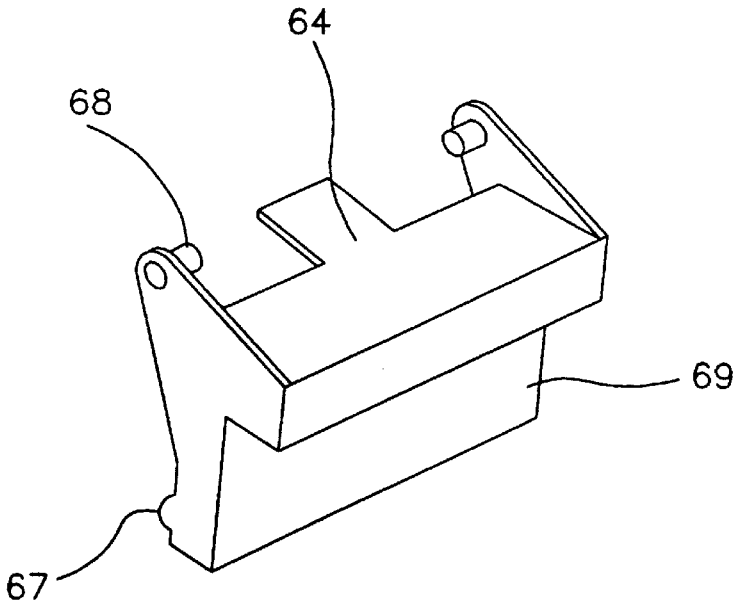
FIG. 8 is a perspective view of the swing lever among the opening device shown in FIG. 7.
Figure 9:
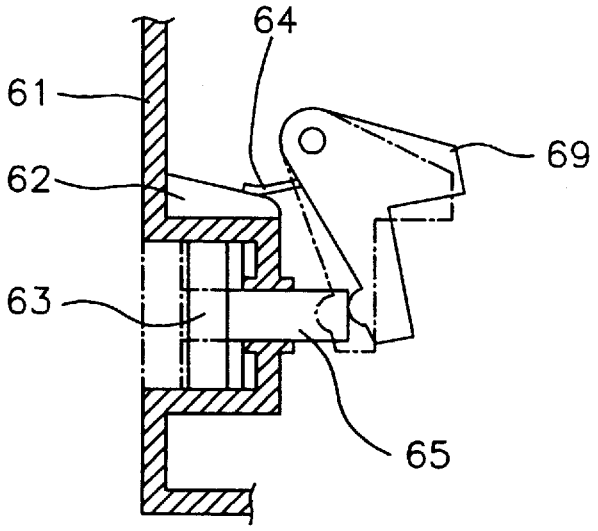
FIG. 9 is an operational view of the opening device shown in FIG. 7.

FIG. 7 is a side sectional view of the opening device for a microwave oven door according to the third embodiment of the present invention, FIG. 8 is a perspective view of the swing lever of the opening device shown in FIG. 7, and FIG. 9 is an operational view of the opening device shown in FIG. 7. As shown in FIGS. 7, 8, and 9 the opening device mainly consists of push button 63 and swing lever 69.

The push button 63 is located under a control panel 61, and capable of being pushed inside the microwave oven at a predetermined distance. Button shaft 65 is installed in push button 63.

The swing lever 69 is installed in the rear surface of control panel 61. A swing shaft 68 is installed to be swung on the rear surface of the control panel 61. A protrusion 67 is formed where the button shaft 65 contacts the swing lever 69.

The one end of the third elastic piece 64 is fixed on the upper surface of the swing lever 69, thus maintaining the same plane, and the other end is elastically attached to a supporting piece 62. The third elastic piece 64 acts like a leaf spring, which forces the bending restoring force to the swing lever 69. This third elastic piece 64 is integrally formed with swing lever 69.

The operation of the first embodiment according to the present invention will be described hereinbelow.

When the user pushes the push button 23 with hand, the push button 23 is pushed inside the microwave oven. Button shaft 25 swings the swing lever 29, thereby contacting the protrusion 27. Then the swing lever 29 swings around the swing shaft 28. The upper surface of the swing lever 29 touchs one end of hook lever 31. The hook lever 31 moved the hook 35 upwardly when swinging. Therefore, the microwave oven door(not shown) is opened.

The first elastic piece 24 is bent by the swing lever 29. This bending restoring force restores the push button 23 and swing lever 29 to their initial position respectively. Therefore, when the user releases the push button 23, the swing lever 29, and push button 23 are also returned to their initial positions.

When the user closes the door, the user swings the door shut directly without any button operation. Therefore, the hook 35 is used to close the door(not shown).

The operation of the second embodiment according to the present invention will be described hereinbelow.

When the user pushes the push button 43 with hand, the push button 43 is pushed inside the microwave oven. Button shaft 45 swings the swing lever 49, thus contacting the protrusion 47. Thereafter, the swing lever 49 swings around the swing shaft 48. The upper surface of the swing lever 49 touchs one end of hook lever 51. The hook lever 51 moves the hook 55 upwardly when swinging. Therefore, the microwave oven door(not shown) is opened.

The second elastic piece 46 is bent by the swing piece 44. This bending restoring force restores the push button 43 and swing lever 49 to their initial positions respectively, when the push button 43 is released. Therefore, when the user releases the push button 43, the swing lever 49 and push button 43 are returned to their initial positions.

When the user closes the door, the user swings the door shut directly without any button operation. Therefore, the hook 55 is used to close the door(not shown).

The operation of the third embodiment according to the present invention will be described hereinbelow.

When the user pushes the push button 63 with hand, the push button 63 is pushed inside the microwave oven. Button shaft 65 swings the swing lever 69, thus contacting the protrusion 67. Then, the swing lever 69 swings around the swing shaft 68. The upper surface of the swing lever 69 touchs one end of hook lever(not shown). The hook lever (not shown) moved the hook(not shown) upwardly as swinging. Therefore, the microwave oven door(not shown) is opened. The hook lever(not shown) and hook(not shown) are the same as the ones in the first embodiment and second embodiment.

The third elastic piece 64 is bent by the supporting piece 62. This bending restoring force restores the push button 63 and swing lever 69 to their initial positions respectively. Therefore, when the user releases the push button 63, the swing lever 69, and push button 63 are returned to their initial positions.

When the user closes the door, the user swings the door shut directly without any button operation. Therefore, the hook (not shown) is used to close the door(not shown).

As a result, the opening device for a microwave oven door according to the present invention can restore the push button to its initial position without special spring part. Therefore, the number of parts is decreased, and the production cost is lowered. Also, the assembling work is improved, since the elastic piece is produced with swing lever integrally.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. In a microwave oven an opening device for a microwave oven door comprising:

a swing lever for opening the door when swinging around a swing shaft at a predetermined angle by a push button installed beside the door; and an elastic piece protrudingly formed as a single unitary piece with an inside of the microwave oven to the swing lever for pressing the swing lever through one direction.

2. The opening device for a microwave oven door as claimed in claim 1, wherein said swing lever is formed with a protrusion in a region that the swing lever is in contact with the push button.

3. The opening device for a microwave oven door as claimed in claim 1, wherein said swing shaft is fixed to be swingable on a rear surface of a control panel which is installed in a front surface of the microwave oven.

4. The opening device for a microwave oven door as claimed in claim 1, wherein said elastic piece is protrudingly formed from a rear surface of a control panel which is installed in a front of the microwave oven.

5. The opening device for a microwave oven door as claimed in claim 1, wherein said elastic piece presses an upper surface of the swing lever elastically.

6. In a microwave oven, an opening device for a microwave oven door comprising:

a swing lever including a protrusion formed in a region where a push button installed beside the door is contacted and a swing shaft fixed to be swingable on a rear surface of a control panel installed in a front of the microwave oven, and for opening the door when swinging around the swing shaft at a predetermined angle by the push button; and an elastic piece protrudingly formed as a single unitary piece with the rear surface of the control panel to an upper surface of the swing lever for pressing the swing lever through one direction, as contacted with the upper surface of the swing lever elastically.

* * * * *